US010962287B2

(12) United States Patent
Kovacic et al.

(10) Patent No.: US 10,962,287 B2
(45) Date of Patent: Mar. 30, 2021

(54) WATER COOLED BOX FOR A METAL MAKING FURNACE

(71) Applicant: Berry Metal Company, Harmony, PA (US)

(72) Inventors: Thomas M Kovacic, Zelienople, PA (US); Kenneth W Geibel, Sarver, PA (US); Edward J Green, Sewickley, PA (US)

(73) Assignee: Berry Metal Company, Harmony, PA (US)

( * ) Notice: Subject to any disclaimer, the term of this patent is extended or adjusted under 35 U.S.C. 154(b) by 193 days.

(21) Appl. No.: 15/922,608

(22) Filed: Mar. 15, 2018

(65) Prior Publication Data

US 2019/0178578 A1 Jun. 13, 2019

Related U.S. Application Data

(63) Continuation-in-part of application No. 29/628,938, filed on Dec. 8, 2017.

(51) Int. Cl.

| | |
|---|---|
| ***F27D 9/00*** | (2006.01) |
| ***F27D 1/12*** | (2006.01) |
| *F27B 14/08* | (2006.01) |

(52) U.S. Cl.

CPC ..... *F27D 9/00* (2013.01); *F27D 1/12* (2013.01); *F27B 2014/0837* (2013.01); *F27D 2009/004* (2013.01); *F27D 2009/0018* (2013.01)

(58) Field of Classification Search

CPC ..... F27D 9/00

See application file for complete search history.

(56) References Cited

U.S. PATENT DOCUMENTS 3,940,552 A * 2/1976 Mizuno ..... F27B 3/12 373/76

4,304,396 A * 12/1981 Udoh ..... F27B 3/24 122/6 A (Continued)

FOREIGN PATENT DOCUMENTS

GB 1451601 10/1976

JP 01010010 A * 1/1989

OTHER PUBLICATIONS

JP01010010A—machine translation (Year: 1989).*

*Primary Examiner* — Nathaniel Herzfeld

(74) *Attorney, Agent, or Firm* — Clark Hill PLC; Adam J. Fromm

(57) ABSTRACT

A water cooled box to be installed in the side wall of a metal making furnace to hold and protect implements such as a burner, a lance, or a material (i.e., carbon or lime) injection device. The box preferably comprises a copper outer shell and a steel inner shell liner welded together, whereby a chamber is formed through which cooling water passes. The box further comprises an inlet and outlet for the water flow and a plurality of conduit passages between the copper and steel shells for mounting the aforementioned implements. The copper shell has bars or slots for slag retention and the steel shell has means for mounting the box into the furnace wall. The copper shell is formed into a curved U-shape for preventing cracking due to thermal mechanical stress and to raise the natural frequency of the panel to resist vibration which can also cause cracking.

20 Claims, 4 Drawing Sheets

(56) References Cited

U.S. PATENT DOCUMENTS

| | | | | |
|---|---|---|---|---|
| 4,453,253 | A * | 6/1984 | Lauria | F27D 1/12 373/74 |
| 6,137,823 | A * | 10/2000 | Johnson | F27B 3/24 373/71 |
| 7,824,604 | B2 | 11/2010 | Higgins et al. | |
| 8,221,675 | B2 * | 7/2012 | Medina | F27B 3/24 266/194 |
| 2007/0058689 | A1 * | 3/2007 | Rymarchyk, Jr. | F27B 3/205 373/76 |
| 2007/0267787 | A1 * | 11/2007 | Higgins | C21C 5/5217 266/190 |
| 2013/0032978 | A1 * | 2/2013 | Glass | F27B 3/085 266/241 |

* cited by examiner

WATER COOLED BOX FOR A METAL MAKING FURNACE

CROSS REFERENCE TO RELATED APPLICATION

This application is a continuation-in-part of U.S. Design Patent Application Ser. No. 29/628,938, filed on Dec. 8, 2017.

FIELD OF THE INVENTION

This technology relates to water cooled boxes that are installed in a side wall of a metal making furnace for the general purpose of housing and protecting various implements used to affect the contents (i.e., a molten metal bath) of the furnace.

BACKGROUND OF THE INVENTION

Metal making furnaces operate under severe conditions. For example, high mechanical stresses are exerted, particularly in furnace vessels, when large amounts of metal scrap weighing many tons are dumped from above into the vessel. The mechanical stress is further compounded by tilting of the vessel to pour the molten metal. Even more significantly, metal making furnaces are exposed to extremely stressful thermal conditions. The temperature around electrodes in an electric arc furnace ("EAF") can reach 6000 degrees Celsius ("° C."), or approximately 11,000 degree Fahrenheit ("° F."). Moreover, the furnace must withstand frequent and vast temperature fluctuations as an EAF furnace can be cycled (i.e., filled with scrap, drained of the melt, and filled, and prepare for filling with scrap again) more than once per hour.

Until the early-1970's, manufacturers of industrial furnaces for metal making attempted to protect the outer steel shell of the furnace from the extreme conditions by completely lining the shell wall with refractory brick. Refractory brick by itself was subject to considerable wear which resulted in periodic furnace outages that decreased production and caused considerable expense. During the mid-1970's, water cooled box type panels, and other panels of various designs, were introduced to replace refractory brick in portions of the furnace vessel outside of the melt zone where molten metal is contained in the furnace vessel. The present invention relates to improvements of these water cooled boxes for metal making furnaces.

Numerous types of water cooled boxes are known. They typically comprise a metal enclosure generally including, but not limited to, the shape of a truncated pyramid mostly of rectangular cross section. The interior of the enclosure is typically arranged to have an inlet and an outlet for cooling water that is circulated through the enclosure for the purpose of cooling the box. In view of their general "box" shape and circulating cooling water, these devices are commonly referred to as "cooling boxes."

Metal making furnaces of the prior art have openings in the vessel wall of the furnace to accommodate these cooling boxes. The cooling boxes are mounted in the openings, whereby the boxes generally extend inwardly toward the inner diameter of the vessel wall. The boxes typically further comprise a nose that, when the box is mounted in the wall, is typically provided in an orientation that faces and is proximal to the molten metal in the vessel. Moreover, the nose of the box is generally located in such a way as to house a device, such as a burner, a lance, or a material (i.e., carbon or lime) injection device, closer to the metal bath to increase the efficiency of the melting or injection process, as the case may be. The closer the injection is to the bath, the deeper the heat, oxygen, or material penetrates into the bath. This construction is advantageous because, for example, a closer location of the injection device relative to the molten metal bath reduces the amount of injected material otherwise lost to a draft out of a top exhaust hole of the furnace.

Some of the known cooling boxes are made from steel, such that they are easy to manufacture and may be welded without substantial difficulty. Additionally, cooling boxes comprised of steel are relatively inexpensive. However, the lifespan of steel boxes is short because the low thermal conductivity of the steel, which allows it to overheat and ultimately deteriorate by way of thermal cracking. A consequence of thermal cracking is the possibility that cooling water will be permitted to leak into the melt, which can result in an explosion.

Other prior art cooling boxes are made from copper or copper alloy, which benefit from the high thermal conductivity of the metal. The principal disadvantage of the all-copper box is the very high price due to the cost of the material. Many of these boxes are plug-welded fabrications or cast monolithic blocks with frequent joints between the exposed sides (i.e., facing the melt) and non-exposed sides. The copper faces of the box that are exposed to the high heat of the furnace will expand significantly, as compared to the copper faces that are otherwise not exposed to the furnace heat. This thermal growth causes significant mechanical stress at joint locations in the box. A consequence of the thermal stress is thermal cracking, which can permit leakage of the cooling water in the molten metal batch of the furnace and result in an explosion.

Therefore, there exists a heretofore unmet need in the art for a novel and inventive water cooled box that alleviates the aforementioned disadvantages of prior art cooling boxes.

SUMMARY OF THE INVENTION

The present invention comprises a water cooled box for installation in a metal making furnace, wherein the box can accommodate the thermal stresses inherent in the metal making process without cracking, while also having a cost of manufacture that is significantly less than that of a primarily copper box.

A preferred embodiment of the present invention comprises a water cooled box for a metal making furnace, the water cooled box comprising: (i) a preferably U-shaped copper outer shell; (ii) a preferably U-shaped steel inner shell liner; (iii) the shell and the liner being welded together to form a chamber through which cooling water passes; (iv) at least one inlet and one outlet water connection to the chamber; (v) one or more conduit passages between the copper shell and the steel shell for mounting devices used to access the metal bath; (vi) a flexible joint where the conduit passage is attached to one of the shells; (vii) the copper shell further comprising slag bars for slag retention on the copper shell; (viii) the steel shell further comprising a flange for mounting the water cooled box into a wall of the furnace; and (ix) the chamber between the copper shell and the steel shell comprising water baffles to direct the water flow in the chamber in a serpentine path for consistent cooling of the outer copper shell of the water cooled box that is exposed to the furnace heat.

The flexible joint may be comprised of a diaphragm flexible joint, which is preferably one or more thin, high-strength metallic diaphragms that reduce restraint in both the radial and axial direction of the conduit passageways.

The flexible joint may be comprised of one or more thin, high-strength cans that allow deformation in the high-strength can that reduces restraint on the conduit passageways.

The flexible joint may be comprised of a bellows with one or more bellows convolutions that reduce restraint in both the radial and axial directions between the copper shell and the steel shell.

The flexible joint may be comprised of a thinned flange on either the bath facing side of the outer shell or the inner shell facing side of the outer shell, the flexible joint reducing radial restraint between the shells.

One of the benefits of the present invention is the ability to separate and replace either of the outer or inner shell if one of the shells should become worn or damaged. The preservation and reuse of the non-damaged shell provides a significant economic benefit over traditional water cooled boxes.

Another preferred embodiment of the present invention comprises:

a water cooled box for use in a metal making furnace, the water cooled box comprising: an outer shell having a substantially U-shaped cross-section, an inner surface, and at least one conduit passageway;

an inner shell having a substantially U-shaped cross-section, an inner surface, a plurality of water baffles, at least one conduit passageway, and at least one mounting flange;

wherein the outer shell is primarily comprised of a metal having a higher thermal conductivity than that of a metal primarily comprising the inner shell;

wherein the outer shell and the inner shell are joined at the at least one mounting flange, thereby defining a chamber through which water flows along a path defined by the water baffles, the inner surface of outer shell, and inner surface of the inner shell; and wherein the at least one conduit passageway of the inner shell or the outer shell comprises a flexible joint.

Yet another preferred embodiment of the present invention comprises:

a water cooled box for use in a metal making furnace, the water cooled box comprising:

an outer shell having a substantially arcuate cross-section, an inner surface, and at least one conduit passageway;

an inner shell having a substantially arcuate cross-section, an inner surface, a plurality of water baffles, at least one conduit passageway, and at least one mounting flange;

wherein the outer shell and the inner shell are joined at the at least one mounting flange, thereby defining a chamber through which water flows along a path defined by the water baffles, the inner surface of outer shell, and inner surface of the inner shell;

wherein the at least one conduit passageway of the outer shell comprises a flange flexible joint formed of material that is thinner than the metal material comprising the outer shell; and wherein the at least one conduit passageway of the inner shell comprises a flexible joint.

DETAILED DESCRIPTION OF THE INVENTION

Figure 1:
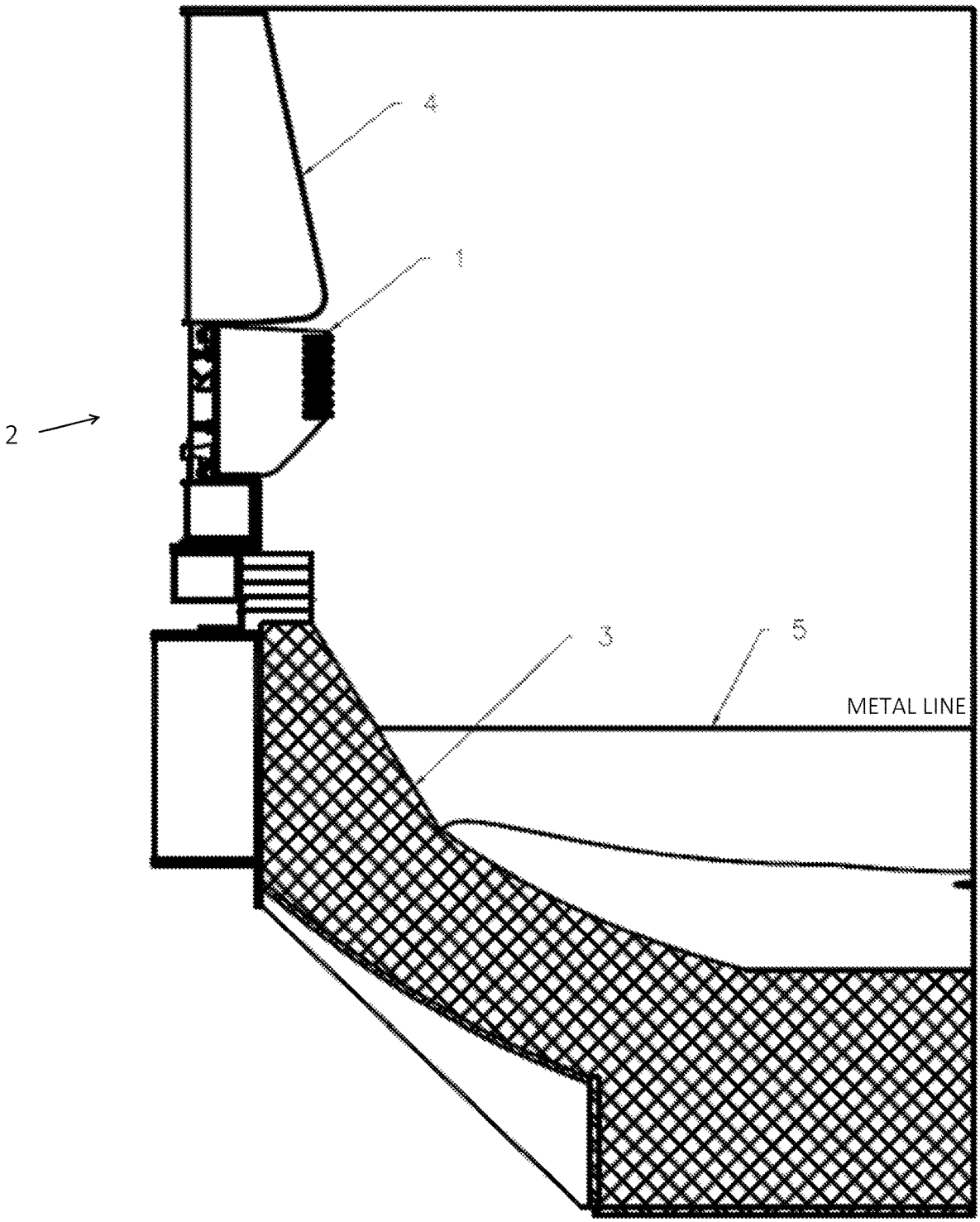
FIG. 1 is an elevated perspective view of a water cooled box provided in accordance with a preferred embodiment of the present invention, the water cooled box being installed in a vessel wall of a metal making furnace.

FIG. 1 illustrates a water cooled box 1 provided in accordance with a preferred embodiment of the present invention, the water cooled box 1 being installed in a metal making furnace 2. As shown, the furnace 2 further comprises a vessel 3, a vessel wall 4, and, during normal operation of the furnace 2, a molten metal bath 5 contained by the vessel 3.

As shown in FIG. 1, the box 1 is preferably mounted on the vessel wall 4 of the metal making furnace 2 using fasteners as will be appreciated by one of ordinary skill in the art. As shown, the furnace 2 has an inner diameter defined by the vessel wall 4, wherein when the box 1 is mounted at a wall 4, the box 1 extends within the inner diameter toward the bath 5. This allows the implements that are deployed through the conduit passageways 14, 24 (see FIGS. 3, 5-7) to affect the bath 5 at a closer distance than that afforded by traditional boxes.

FIGS. 2-7 illustrate the water cooled box 1 comprising an outer shell 10 and an inner shell 20. The outer shell 10 comprises an inner surface 11, an outer surface 12, one or more conduit passageways 14, and one or more slag retention bars 15. In some alternative embodiments, the outer shell 10 may comprise slag retention grooves 16 instead of bars 15 on the outer surface 12. In other alternative embodiments, the outer shell 10 may comprise a combination of grooves 16 and bars 15. The outer surface 12 further comprises a plurality of faces, including bottom face 17*a*, side faces 17*b*, 17*c*, curved face 17*d*, conduit face 17*e*, and top face 17*f*.

Figure 2:
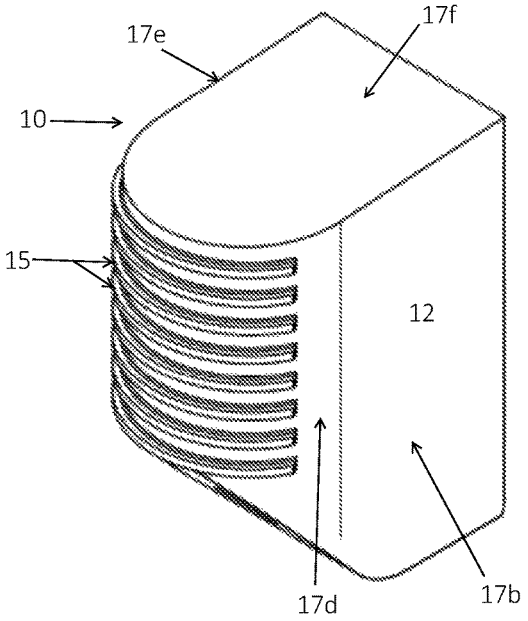
FIG. 2 is an elevated perspective view of an outer surface of an outer shell of a water cooled box provided in accordance with a preferred embodiment of the present invention.
Figure 3:
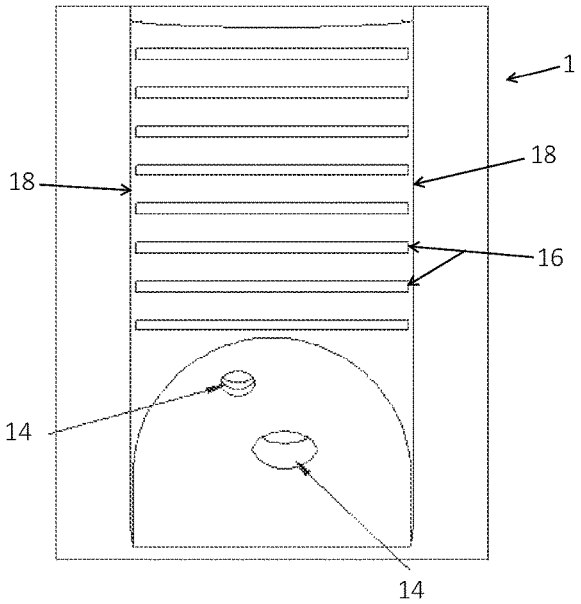
FIG. 3 is a front perspective view (the surfaces facing toward the bath when mounted in a furnace) of a water cooled box provided in accordance with a preferred embodiment of the present invention.

The outer shell 10 is preferably comprised primarily of copper and is formed to have a substantially U-shaped or substantially arcuate profile in cross-section, wherein the curved face 17*d* is directed toward the bath 5. More specifically, as best shown in FIG. 2, the U-shaped profile of the outer shell 10 is substantially defined by the shape of the top face 17*f*, which is typically oriented perpendicularly to the vessel wall 4 when the box 1 is mounted thereon. As shown, the legs of the U-shaped top face 17*f* are substantially linear and abut the respective top edges of side faces 17*b*, 17*c*, whereas the curved portion of the top face 17*f* abuts a top edge of the curved face 17*d*. Thereby, the substantially U-shaped profile of the outer shell 10 is formed, and it persists away from the top face 17*f* to a certain depth of the outer shell 10 until the U-shaped profile is truncated at the curved face 17*d* by the conduit face 17*e* toward the bottom face 17*a*.

The inner shell 20 comprises an inner surface 21, an outer surface 22, water baffles 23, one or more conduit passageways 24, a water inlet 25, a water outlet 26, first and second mounting flanges 13*a*, 13*b*, and a top flange 28. The inner shell 20 also provides strength to hold the shape and position of the outer shell 10, and the use of steel rather than copper in the inner shell 20 reduces the cost of the box 1. The one or more conduit passageways 14, 24 of the outer shell 10 and the inner shell 20, respectively, are complementary in shape as well. Various implements, such as a burner, a lance, or a material (i.e., carbon or lime) injection device may be protected and deployed through the body of the box 1 via the passageways 14, 24 and into the furnace 2.

Figure 4:
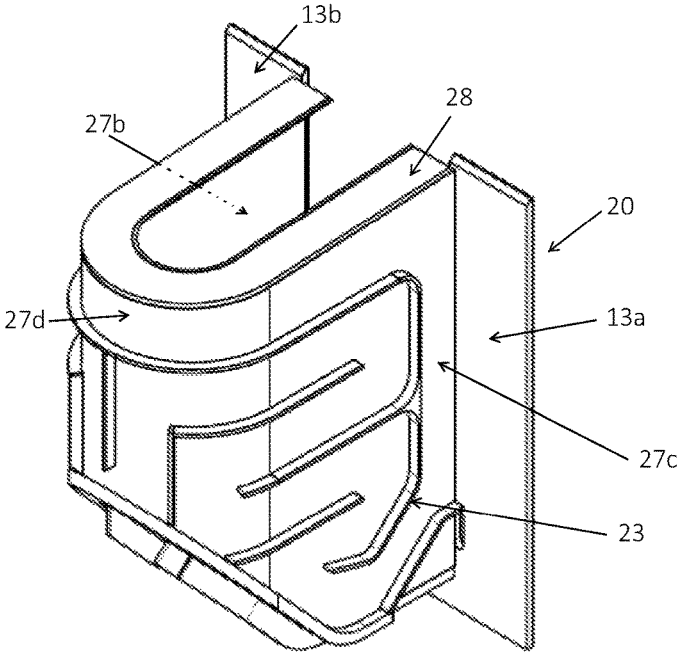
FIG. 4 is an elevated perspective view of an inner surface of an inner steel shell of a water cooled box provided in accordance with a preferred embodiment of the present invention.
Figure 5:
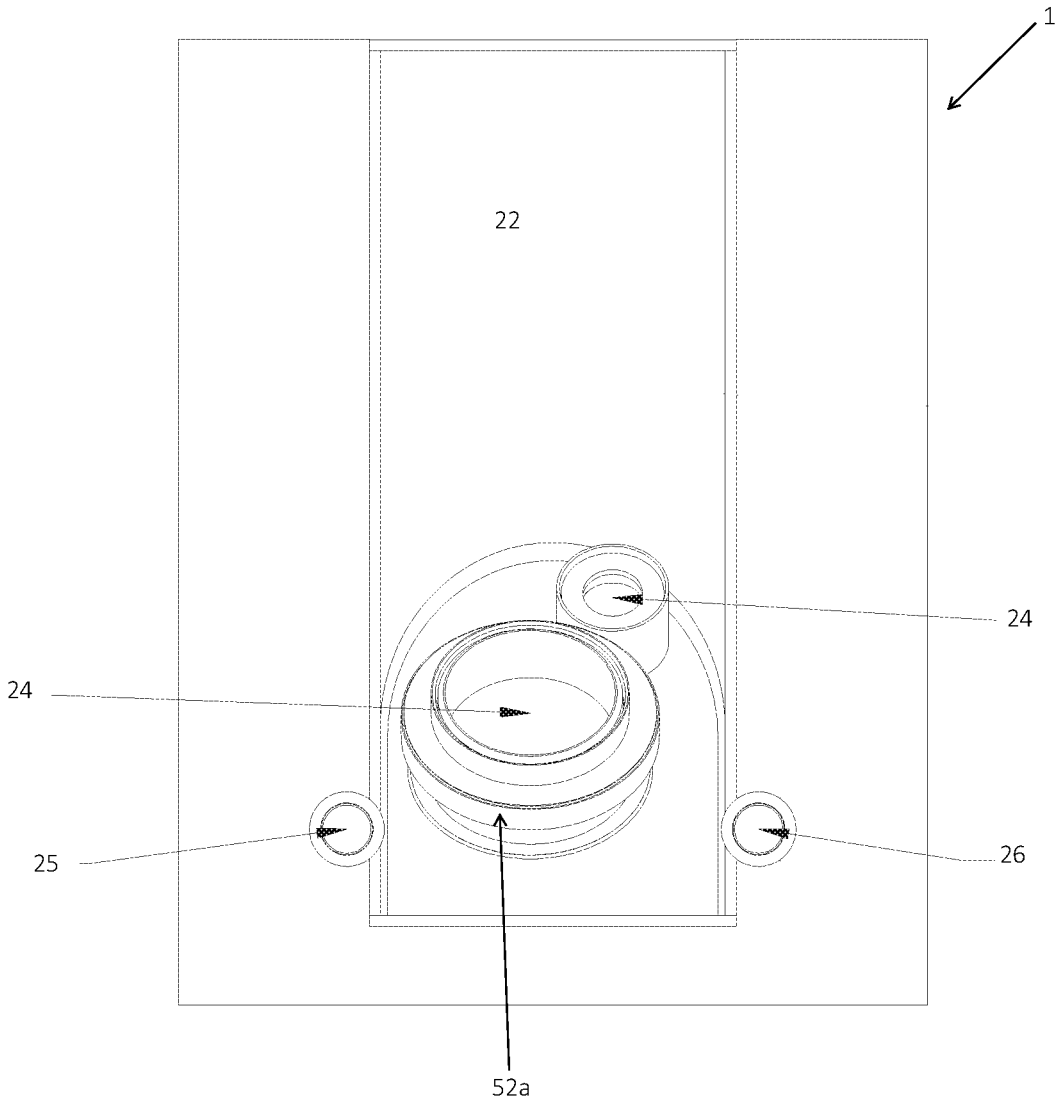
FIG. 5 is a back perspective view (the surfaces facing away from the bath when mounted in a furnace) of a water cooled box provided in accordance with a preferred embodiment of the present invention.

The inner shell 20 is preferably formed of steel, and has a substantially U-shaped or substantially arcuate profile in cross-section that is complementary to the shape of the outer shell 10. The inner shell 20 may be formed of stainless steel. The inner shell 20 further comprises a plurality of faces, including bottom face 27*a*, side faces 27*b*, 27*c*, curved face 27*d*, and conduit face 27*e*. More specifically, as best shown in FIG. 4, U-shaped profile of the inner shell 20 is substantially defined by the respective top edges of side faces 27*b*, 27*c* and curved face 27*d*. Thereby, the substantially U-shaped profile of the inner shell 20 is formed, and it persists to a certain depth of the inner shell 20 until the U-shaped profile is truncated at the curved face 27*d* by the conduit face 27*e* toward the bottom face 27*a*.

Returning to FIGS. 2 and 3, as shown, the slag retention bars 15 and/or grooves 16 of the outer shell 10 catch slag of the furnace 2 and cause slag buildup on the outer surface 12 of the outer shell 10. The slag buildup acts as both a thermal and electrical insulator for the water cooled box 1. This is because the thermal conductivity of the slag buildup is fairly low, thereby reducing the amount of heat that is transferred from the molten metal bath 5 to the outer surface 12 of the outer shell 10. The thermal conductivity of the copper preferably comprising the outer shell 10, by contrast, is very high, which allows heat that is transferred to the outer shell 10 to efficiently and quickly pass through the outer shell 10 into water that is circulating through a water chamber 30 (described further below), which carries the heat away from the box 1.

Figure 6:
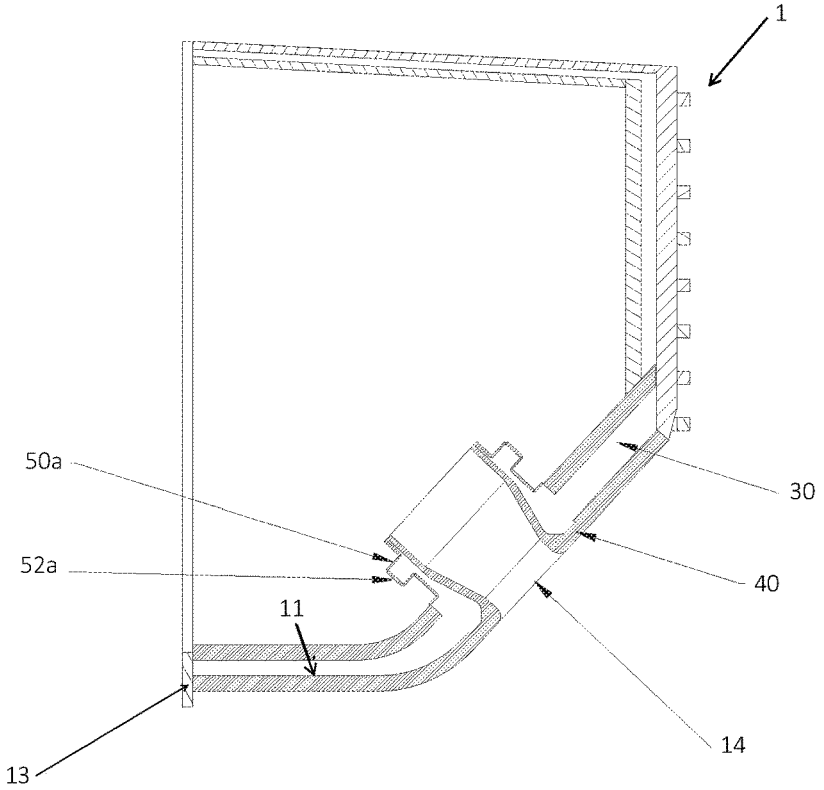
FIG. 6 is a cross-sectional view of a water cooled box provided in accordance with a preferred embodiment of the present invention, the box comprising flexible joints.
Figure 7:
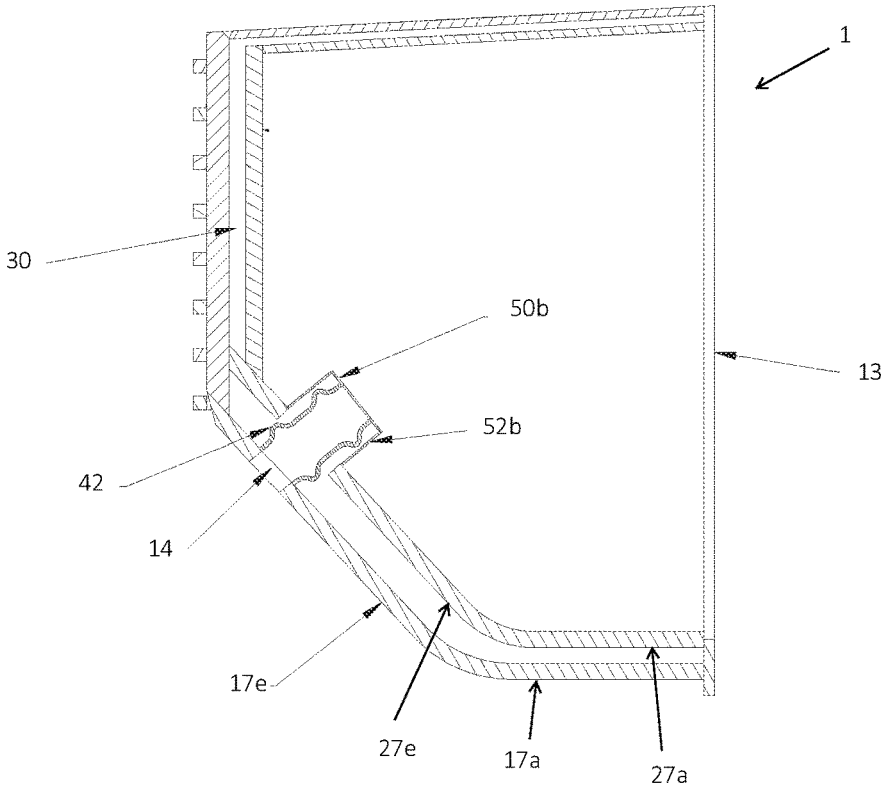
FIG. 7 is a cross-sectional view of a water cooled box provided in accordance with a preferred embodiment of the present invention, the box comprising alternative flexible joints.

As best shown in FIGS. 6 and 7, the water cooled box 1 is formed by fitting the inner shell 20 into the outer shell 10. More specifically, the inner surface 11 of the outer shell 10 is married to the inner surface 21 of the inner shell 20 such that the shells 10, 20 are united to define the water chamber 30 between the inner surfaces 11, 21. The outer shell 10 is cooled by water that enters the box 1 via the inlet 25, is directed through the water chamber 30 by the baffles 23, and exits the box 1 via the outlet 26. The inlet 25 and the outlet 26 are preferably welded to the mounting flanges 13*a*, 13*b*, and inlet 25 and outlet 26 defining respective apertures that extend through the flanges 13*a*, 13*b* into the chamber 30.

The shells 10, 20 are joined at lateral back edges 18 of the outer shell 10 to the mounting flanges 13*a*, 13*b*, preferably by welding, at the inner surface 11 portion of the top face 17*f* to the top flange 28, preferably by welding, and also at the complementary conduit passageways 14, 24. The conduit passageways 14, 24 preferably have a flexible connection at a joint to one of the shells 10, 20, or the conduit passageways 14, 24 have a flexible member comprising the conduit passageways 14, 24 themselves.

For example, in a preferred embodiment as shown in FIG. 6, the box 1 comprises conduit passageways 14, 24 wherein the conduit passageway 14 of the outer shell 10 is preferably formed of metal having a substantial thickness and comprising a flange flexible joint 40 that is joined to the outer shell 10, preferably by welding. The conduit passageway 24 of the inner shell 20, meanwhile, is preferably comprised of a diaphragm flexible joint 50*a* and a can flexible joint 52*a*, wherein the joints 50*a*, 52*a* connect the conduit passageway 14 of the outer shell 10 to the inner shell 20. The diaphragm flexible joint 50*a* and a can flexible joint 52*a* are preferably ring-shaped devices that surround the conduit passageway 14.

In an alternative embodiment as shown in FIG. 7, the box 1 comprises conduit passageways 14, 24 wherein the conduit passageway 14 of the outer shell 10 is preferably formed of a bellows flexible joint 42. The bellows flexible joint 42 is substantially cylindrical. The conduit passageway 24 of the inner shell 20, meanwhile, is preferably comprised of a diaphragm flexible joint 50*b* and a can (or cup) flexible joint 52*b*. As shown in FIG. 7, the bellows flexible joint 42 is connected at a first end to the outer shell 10 and at a second to the diaphragm flexible joint 50*b*. The can flexible joint 52*b* is connected at a first end to the diaphragm flexible joint 50*b* and at a second end to the inner shell 20.

As shown in FIGS. 6 and 7, the water in the chamber 30 will flow between the flexible joint mechanisms 40, 42 of the outer shell 10 and the flexible joint mechanisms 50*a,b*, 52*a,b* of the inner shell 20.

When the temperature of most objects is increased, the volume (length, width, and height) of the object increases. As long as the object is not restrained, the stress state of the object remains unchanged. When the temperature of an object is increased and the object is restrained in one or more planes, the volume of the object cannot increase in the direction of the restraint. This subjects the object to mechanical stress.

During operation of the furnace 2, the temperature of the inner shell 20 formed of steel is almost the same as the temperature of the cooling water circulating through the water chamber 30. The cooling water temperature is much cooler than the temperature of the outer shell 10 formed of copper, and therefore the temperature of the inner shell 20 is much lower than that of the outer shell 10. Further, the coefficient of thermal growth of steel is much lower than that of copper. Between the temperature differential and dissimilar coefficients of thermal growth between the copper and steel preferably comprising the outer shell 10 and the inner shell 20, respectively, the outer shell 10 grows thermally much more than the inner shell 20. Accordingly, points of restraint between the two shells 10, 20 may create a thermal mechanical stress on the box 1.

To offset this potential mechanical stress, the curved U-shape of the box 1 allows the outer shell 10 to move out of plane, thereby reducing the in-plane restraint experienced by the outer shell 10, as compared to the in-plane restraint experienced by traditional flat plate surfaces fixed between two side walls. This is one of the mechanical stress reduction mechanisms of the present invention.

It is noted that the metal making processes in which furnaces such as furnace 2 are employed are, by nature, a very violent processes that cause vibration in essentially everything with a certain proximity to the process being performed. When an object is vibrated at its natural frequency, the vibrational energy is amplified and the energy from this amplification can create cracking in traditional furnace components. This cracking can cause cooling water to leak into the furnace, which can result in an explosion. The U-shaped surface of the outer shell 10 has a higher natural frequency than a flat plate surface of traditional water cooled boxes. Higher frequency vibration has less energy that low frequency vibration, which reduces energy available to create cracks and thereby enhances the durability and integrity of the outer shell 10.

Additionally, the outer shell 10 and the inner shell 20 of the box 1 are joined at the mounting flanges 13*a*, 13*b* and at the conduit passageways 14, 24 between shells 10, 20. The flanges 13*a*, 13*b* are the coldest parts of the box 1 and the thermal growth difference between the outer shell 10 and the inner shell 20 at the mounting flanges 13, 13*b* is minimal. Consequently, the thermal mechanical stress at the connection of the shells 10, 20 at the mounting flanges 13, 13*b* is low enough that it will not cause cracking.

By contrast, the conduit passageways 14, 24 between shells 10, 20 are located at the highest differential temperature between the shells 10, 20 and will experience the high thermal mechanical stress sufficient to cause cracking in traditional water cooled boxes. The conduit passageways 14, 24 of the present invention, however, have one or more flexible joint mechanisms 40, 42, 50*a,b*, 52*a,b* either at the joint of the passageway 14, 24 to its corresponding shell 10, 20 or a flexible member designed into the conduit passageway 14, 24 itself. The flexible joint mechanisms 40, 42, 50*a,b*, 52*a,b* are preferably formed of a copper alloy, such as a copper-nickel alloy.

This flexible joint mechanism reduces the restraint between shells 10, 20 due to thermal growth and thereby reduces the thermal mechanical stress experienced by the box 1. Some flexible joint mechanisms for this invention, such as diaphragm flexible joints 50*a*, 50*b*, include the use of a plurality of thin high-strength metallic diaphragms that reduce restraint in both the radial and axial direction of the conduit passageways 14, 24. Alternative flexible joint mechanisms, such as can flexible joints 52*a*, 52*b*, include the use of thin metallic high strength cans that allow deformation in the can that reduces restraint of the conduit passageways 14, 24. Other alternative flexible joint mechanisms, such as flexible bellows joint 42, are designed into the conduit passageway, particularly conduit passageway 14. The flexible bellows joint 42 is formed like a bellows with a plurality of bellows convolutions to reduce both axial and radial restraint between the outer shell 10 and inner shell 20. As the box 1 heats up and experiences thermal growth, the bellows joint 42 will tend to straighten out, thereby absorbing mechanical stress of the box 1. Yet another alternative flexible joint mechanism, such as flange flexible joint 40, comprises a separate article that is preferably thinner than the surrounding metal of the outer shell 10, and welded onto the outer shell 10 at either the inner surface 11 or the outer surface 12. One or more flange flexible joints 40 may be used. For example, if two flange flexible joints 40 are used, one may be connected to the inner surface 11 and another may be connected to the outer surface 12. The flange flexible joint 40 reduces radial restraint between the shells 10, 20. The flexible joint mechanisms 40, 42, 50*a*, 50*b*, 52*a*, 52*b* may be used independently (i.e., without other flexible joint mechanisms in the box 1) or in combination with one or more flexible joint mechanisms 40, 42, 50*a*, 50*b*, 52*a*, 52*b*.

The invention claimed is:

1. A water cooled box for use in a metal making furnace, the water cooled box comprising:

an outer shell having a substantially U-shaped cross-section, an inner surface, and at least one conduit passageway;

an inner shell having a substantially U-shaped cross-section, an inner surface, a plurality of water baffles, at least one conduit passageway, and at least one mounting flange;

wherein the outer shell is primarily comprised of a metal having a higher thermal conductivity than that of a metal primarily comprising the inner shell;

wherein the outer shell and the inner shell are joined by at least one flexible joint and by the at least one mounting flange, thereby defining a chamber through which water flows along a path defined by the water baffles, the inner surface of outer shell, and inner surface of the inner shell; and wherein the at least one conduit passageway of the inner shell and the at least one conduit passageway of the outer shell are connected by the at least one flexible joint.

2. The water cooled box of claim 1, wherein the outer shell is primarily comprised of copper.

3. The water cooled box of claim 2, wherein the inner shell is primarily comprised of steel.

4. The water cooled box of claim 1, wherein the outer shell further comprises one or more slag retention bars.

5. The water cooled box of claim 1, wherein the outer shell further comprises one or more slag retention grooves.

6. The water cooled box of claim 1, wherein the at least one conduit passageway of the outer shell further comprises a flange flexible joint.

7. The water cooled box of claim 1, wherein the outer shell comprises at least two conduit passageways and the inner shell comprises at least two conduit passageways, a water inlet, and a water outlet.

8. The water cooled box of claim 1, wherein the at least one conduit passageway of the outer shell and the at least one conduit passageway of the inner shell are complementary structures through which an implement may be deployed.

9. The water cooled box of claim 8, wherein the implement is selected from the group consisting of a burner, lance, and material injector.

10. The water cooled box of claim 1, wherein the metal making furnace further comprises an inner diameter defined by the vessel wall of the furnace, and wherein when the box is mounted at the vessel wall, the box extends within the inner diameter toward the center of the furnace.

11. The water cooled box of claim 10, wherein the outer shell comprises a curved face defined by the curved portion of the U-shaped cross-section, the curved face extending within the inner diameter and facing the center of the furnace.

12. The water cooled box of claim 1, wherein the at least one flexible joint is a diaphragm flexible joint.

13. The water cooled box of claim 1, wherein the at least one flexible joint is a can flexible joint.

14. The water cooled box of claim 1, wherein the at least one flexible joint is a bellows flexible joint.

15. The water cooled box of claim 1, wherein the at least one flexible joint comprises a diaphragm flexible joint, a can flexible joint, and a bellows flexible joint.

16. The water cooled box of claim 6, wherein the flange flexible joint is formed of material that is thinner than the metal material comprising the outer shell.

17. A water cooled box for use in a metal making furnace, the water cooled box comprising:

an outer shell having a substantially arcuate cross-section, an inner surface, a conduit face, and at least one conduit passageway;

an inner shell having a substantially arcuate cross-section, an inner surface, a plurality of water baffles, at least one conduit passageway, and at least one mounting flange;

wherein the outer shell and the inner shell are joined by at least one flexible joint and by the at least one mounting flange, thereby defining a chamber through which water flows along a path defined by the water baffles, the inner surface of outer shell, and inner surface of the inner shell;

wherein the at least one conduit passageway of the outer shell comprises a flange flexible joint that connects the at least one conduit passageway of the outer shell to the conduit face of the outer shell, and wherein the flange flexible joint is formed of material that is thinner than a metal material comprising the conduit face of outer shell; and wherein the at least one conduit passageway of the inner shell and the at least one conduit passageway of the outer shell are connected by the at least one flexible joint.

18. The water cooled box of claim 17, wherein the outer shell, including the conduit face of the outer shell, is primarily comprised of a metal having a higher thermal conductivity than that of a metal primarily comprising the inner shell.

19. The water cooled box of claim 17, wherein the at least one flexible joint is a diaphragm flexible joint.

20. The water cooled box of claim 17, wherein the at least one flexible joint is a can flexible joint or a bellows flexible joint.

* * * * *